US011564500B1

(12) United States Patent
Palma

(10) Patent No.: US 11,564,500 B1
(45) Date of Patent: Jan. 31, 2023

(54) MESH CHAIR WITH FULL LUMBAR BACK SUPPORT

(71) Applicant: Alberto Palma, Costa Mesa, CA (US)

(72) Inventor: Alberto Palma, Costa Mesa, CA (US)

( * ) Notice: Subject to any disclaimer, the term of this patent is extended or adjusted under 35 U.S.C. 154(b) by 0 days.

(21) Appl. No.: 17/394,174

(22) Filed: Aug. 4, 2021

(51) Int. Cl.
*A47C 7/46* (2006.01)
*A47C 7/28* (2006.01)
*A47C 7/44* (2006.01)

(52) U.S. Cl.
CPC ..... *A47C 7/44* (2013.01); *A47C 7/46* (2013.01); *A47C 7/462* (2013.01)

(58) Field of Classification Search
CPC ..... A47C 7/44; A47C 7/462; A47C 7/46
USPC ..... 297/284.3, 284.4, 452.56
See application file for complete search history.

(56) References Cited

U.S. PATENT DOCUMENTS 5,112,106 A * 5/1992 Asbjornsen ..... A47C 7/405 297/284.7
6,572,190 B2 * 6/2003 Koepke ..... A47C 7/282 297/284.4 X
6,588,842 B2 * 7/2003 Stumpf ..... A47C 7/282 297/284.4 X
6,938,956 B1 * 9/2005 Piretti ..... A47C 7/38 297/284.7
7,303,232 B1 * 12/2007 Chen ..... A47C 7/38 297/284.7
7,396,082 B2 * 7/2008 Sanchez ..... A47C 7/46 297/284.4
7,445,287 B2 * 11/2008 Chou ..... A47C 7/46 297/284.4 X
7,625,046 B2 * 12/2009 Sanchez ..... A47C 7/402 297/284.4 X
7,874,619 B2 * 1/2011 Harley ..... A47C 7/46 297/284.4
8,449,037 B2 * 5/2013 Behar ..... A47C 5/12 297/284.4 X
8,573,697 B1 * 11/2013 Su ..... A47C 7/462 297/284.7
8,926,016 B2 * 1/2015 Behar ..... A47C 7/46 297/284.4 X
9,301,615 B2 * 4/2016 Behar ..... A47C 7/44
9,480,340 B1 * 11/2016 Harlow ..... A47C 7/46
(Continued)

FOREIGN PATENT DOCUMENTS

DE 202020105747 U1 * 12/2020 ..... A47C 7/462
KR 20100107296 A * 5/2010 ..... A47C 7/462
(Continued)

*Primary Examiner* — Rodney B White
(74) *Attorney, Agent, or Firm* — Morland C. Fischer

(57) ABSTRACT

A home or office chair is disclosed having a flexible mesh back rest and a full lumbar back support including upper and lower lumbar supports that are located one above the other at the back of the chair to press against the outside of the mesh back rest. The upper and lower lumbar supports are connected to the back of the chair by a bolt so as to move back and forth in first and opposite directions in response to a user seated in the chair moving his back against and away from the flexible mesh back rest. The upper and lower lumbar supports of the full lumbar back support apply continuous pressure through the mesh back rest to provide support for upper and lower lumbar areas of the user's back regardless of whether the user's back is at rest or pressing against the mesh back rest.

12 Claims, 8 Drawing Sheets

(56) References Cited

U.S. PATENT DOCUMENTS 10,004,337 B2 * 6/2018 Grove ..... A61H 15/00
10,058,184 B1 * 8/2018 Philemon ..... A47C 7/425
10,264,890 B2 * 4/2019 Aldrich ..... A47C 7/462
10,272,282 B2 * 4/2019 Harlow ..... A47C 7/746
10,667,612 B2 * 6/2020 Matlin ..... A47C 7/14
10,827,841 B1 * 11/2020 Tsai ..... A47C 7/405
10,966,530 B2 * 4/2021 Masunaga ..... A47C 7/46
11,253,076 B2 * 2/2022 Motley ..... A47C 7/44
2004/0140701 A1 * 7/2004 Schmitz ..... A47C 7/44
297/284.4
2005/0035638 A1 * 2/2005 Pennington ..... A47C 1/03255
297/300.4
2005/0062323 A1 * 3/2005 Dicks ..... A47C 7/402
297/284.4
2005/0104428 A1 * 5/2005 Walker ..... A47C 7/46
297/284.4
2005/0189810 A1 * 9/2005 Wu ..... A47C 7/40
297/452.29
2006/0238006 A1 * 10/2006 Baranov ..... A47C 1/0303
297/284.3
2010/0078975 A1 * 4/2010 Kang ..... A47C 7/462
297/230.13
2010/0164266 A1 * 7/2010 Walters ..... B60N 2/666
297/354.11
2012/0193959 A1 * 8/2012 Chen ..... A47C 7/38
297/301.1
2016/0157617 A1 * 6/2016 Galbreath ..... A47C 27/087
297/452.41
2016/0360889 A1 * 12/2016 Matlin ..... A47C 7/462
2016/0374474 A1 * 12/2016 Wu ..... A47C 7/462
297/284.4
2017/0035204 A1 * 2/2017 Su ..... A47C 1/03255
2017/0340121 A1 * 11/2017 Chen ..... A47C 7/462
2017/0354260 A1 * 12/2017 Aldrich ..... A47C 7/282
2018/0116405 A1 * 5/2018 Gerbino ..... A47C 7/462
2019/0281988 A1 * 9/2019 Su ..... A47C 7/46
2019/0365102 A1 * 12/2019 Kolberg ..... A47C 7/445
2021/0085083 A1 * 3/2021 Beech ..... A47C 3/0251

FOREIGN PATENT DOCUMENTS

KR 101296612 B1 * 8/2013 ..... A47C 7/462
NO 325146 B1 * 2/2008 ..... A47C 1/022

* cited by examiner

MESH CHAIR WITH FULL LUMBAR BACK SUPPORT

BACKGROUND OF THE INVENTION

1. Field of the Invention

This invention relates to a chair for use in a home or office and having a mesh back rest and a full lumbar back support connected to the back of the chair so as to press against the outside of the mesh back rest at which to apply a continuous pressure to support upper and lower lumbar areas of the back of a user seated in the chair and leaning back. The full lumbar back support described herein includes upper and lower lumbar supports that are located one above the other so as to move back and forth in response to the user's back being moved against and away from the mesh back rest of the chair.

2. Background Art

Home and office chairs are known which include a flexible mesh back. Such a mesh back is often flimsy and, therefore, may not provide firm support to both the upper and lower lumbar areas of the back of a user seated in the chair and leaning back. As a consequence of the user's entire back not being fully and adequately supported by a conventional mesh chair back, the user may experience discomfort, especially when being seated in the chair for a long period of time.

Accordingly, what would be desirable to overcome the lack of full and adequate back support available from a traditional mesh chair back is a full lumbar back support to be connected to the back of the chair at which to press against the mesh back thereof and apply pressure to support both upper and lower lumbar areas of the user's back when the user's back is at rest or pushing back against the mesh back.

SUMMARY OF THE INVENTION

In general terms, a home or office chair is described of the kind having a flexible mesh back rest to receive the back of a user seated in the chair and leaning back. The chair herein described includes a full lumbar back support that is connected to the back of the chair so as to press against the outside of the mesh back rest. By virtue of the foregoing, a pressure is continuously applied to support both upper and lower lumbar areas of the user's back whether the user's back is at rest or pushing back against the mesh back rest.

According to a first embodiment, a one-piece full lumbar back support is disclosed including flexible upper and lower lumbar supports that are coextensively joined one above the other by an integral joint so as to lay over and against upper and lower lumbar areas of the user's back. Each of the upper and lower lumbar back supports has a cushion pad attached thereto. The upper and lower lumbar supports are contoured to conform to the shape of the user's upper and lower lumbar areas. A pass-through bolt runs laterally through the joint between the upper and lower lumbar supports by which the full lumbar back support is fixedly connected to the back of the chair. The flexible upper and lower lumbar supports are adapted to bend back and forth when the back of the seated individual is first moved in a first direction against the mesh back rest and is then moved in an opposite direction away from the mesh back rest.

In another embodiment, a two-piece full lumbar back support is disclosed including upper and lower lumbar supports that are connected one above the other and pivotally connected to the back of the chair by a laterally extending pass-through bolt. Each of the upper and lower lumbar supports of the two-piece full lumbar back support is engaged by a (e.g., coil) spring. When the user leans back in the chair against the mesh back rest, the upper and lower lumbar supports rotate backwards and in a first direction around the pass-through bolt, whereby the springs are compressed and store energy. When the user leans forward, the springs will expand and release their stored energy, whereby to cause the upper and lower lumbar supports to rotate forwards and in an opposite direction so as to press against the mesh back rest.

DESCRIPTION OF THE PREFERRED EMBODIMENT

Figure 1:
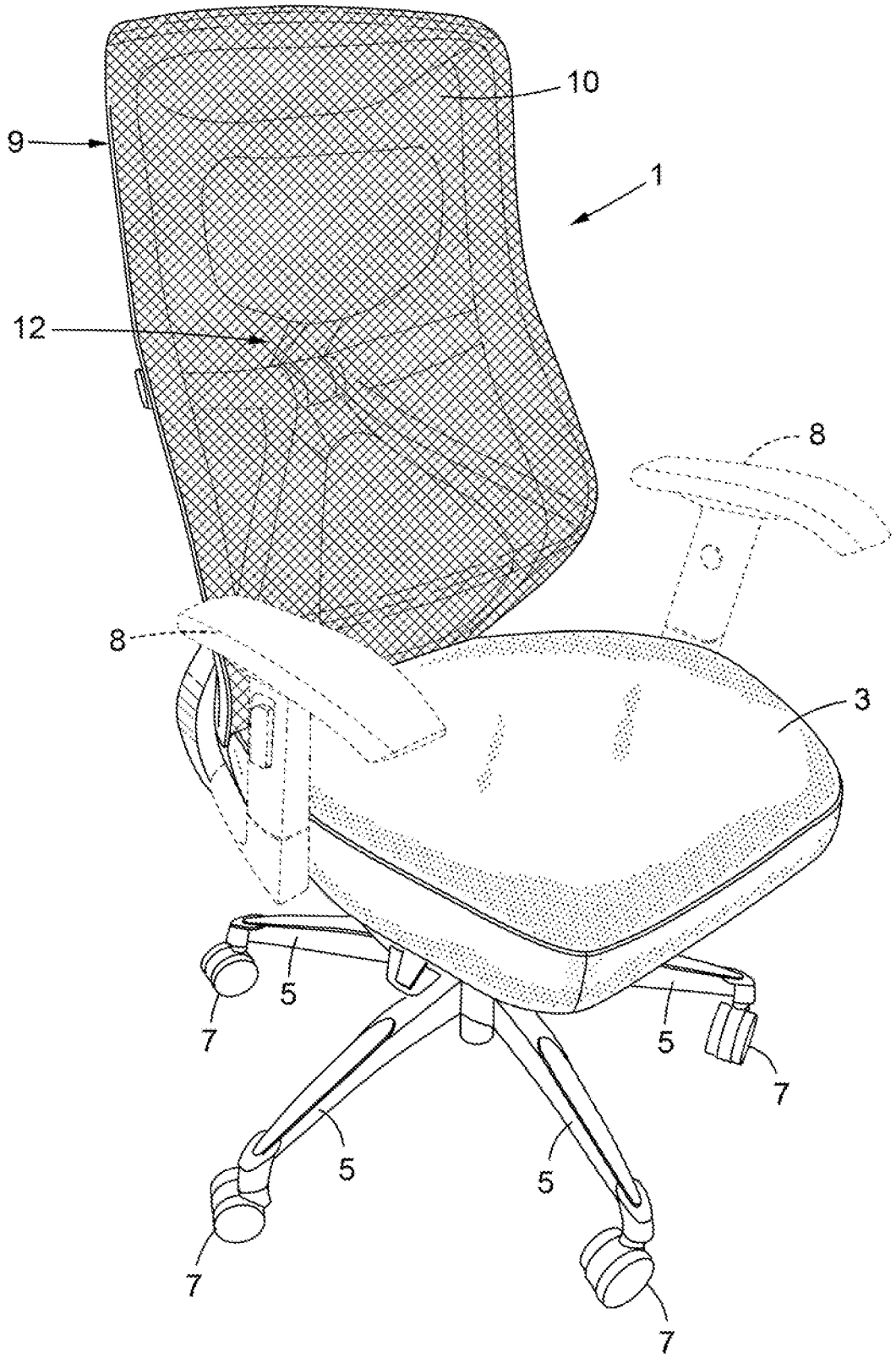
FIG. 1 shows a chair having a mesh back rest and a one-piece full lumbar back support that is connected to the back of the chair at which to engage the mesh back rest so as to apply a continuous pressure to upper and lower lumbar areas of the back of a user seated in the chair and leaning back against the mesh back rest.

Referring initially to FIG. 1 of the drawings, there is shown a chair 1 for use in a home or office. The chair 1 has a seat 3 to support the weight of a user and a set of legs 5 located below the seat 3 to hold the seat off the ground. A corresponding set of rollers 7 are attached to respective ones of the legs 5 to enable the chair to roll from place-to-place. A pair of optional arms 8 are located at opposite sides of the seat 3 to establish rests for the user's arms. A back 9 stands upwardly from the rear of the chair behind the seat 3 to be engaged by the user's back when the user leans back while seated in the chair 1. In this case, the chair back 9 includes a back rest 10 that is manufactured from a flexible material such as mesh, or the like, against which the back of the user is moved.

As will be known to those familiar with chairs having a mesh back rest, such chairs typically lack adequate back support that is capable of applying a firm pressure to support both the upper and lower lumbar areas of the back of a user who sits in the chair and leans back. To overcome this disadvantage, the back of the chair 1 is advantageously provided with a full lumbar back support to press against and apply pressure to the outside of the mesh back rest 10. As will be disclosed in greater detail hereinafter, the full lumbar back support is adapted to provide a continuous pressure through the mesh back rest 10 to provide support for both the upper and lower lumbar areas of the user's back whether the user's back is at rest or pushing back against the mesh.

Figure 2:
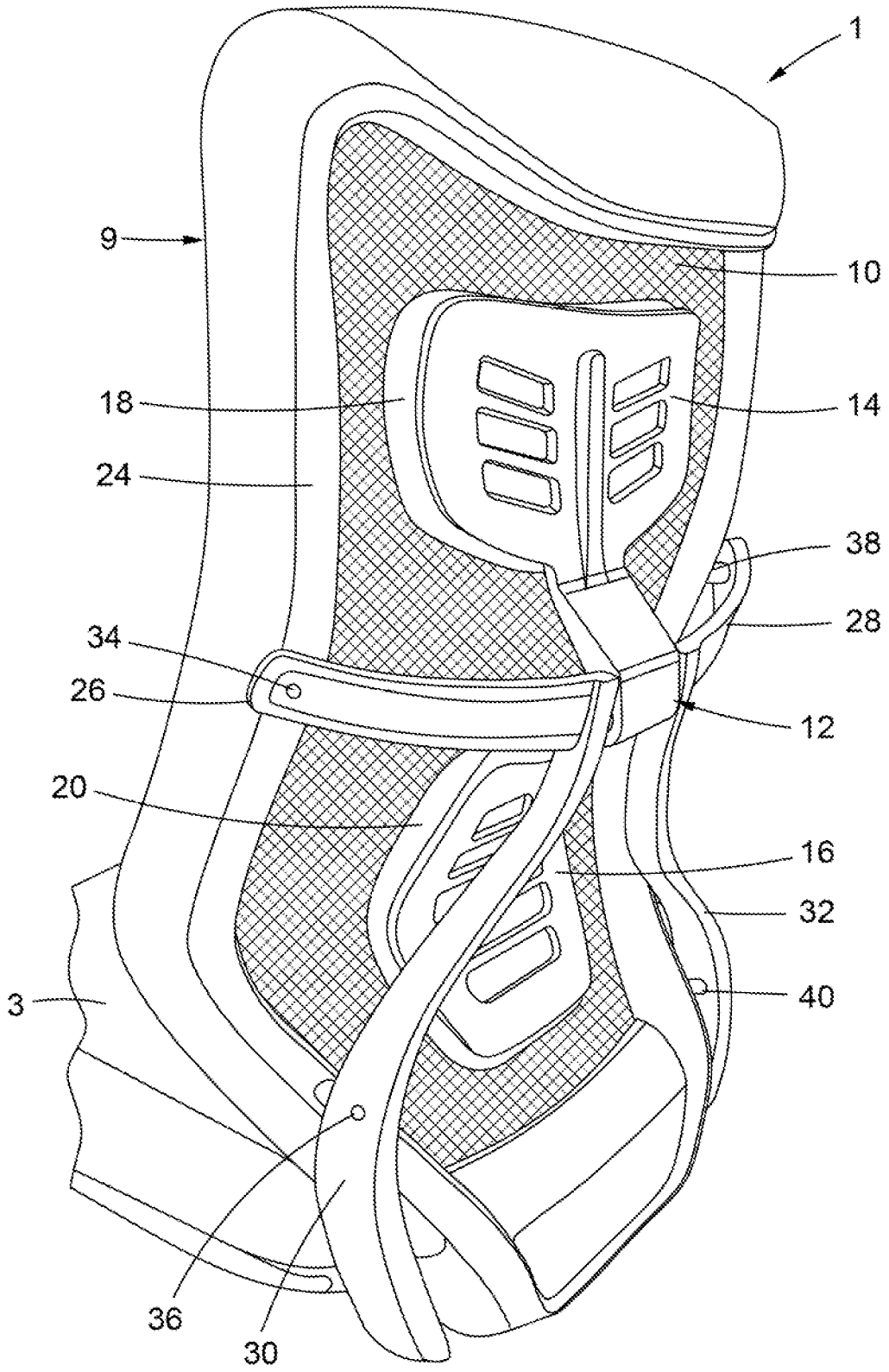
FIG. 2 shows the back of the chair of FIG. 1 and upper and lower lumbar supports of the one-piece full lumbar back support connected to the chair back and pressing against the mesh back rest of the chair.
Figure 4:
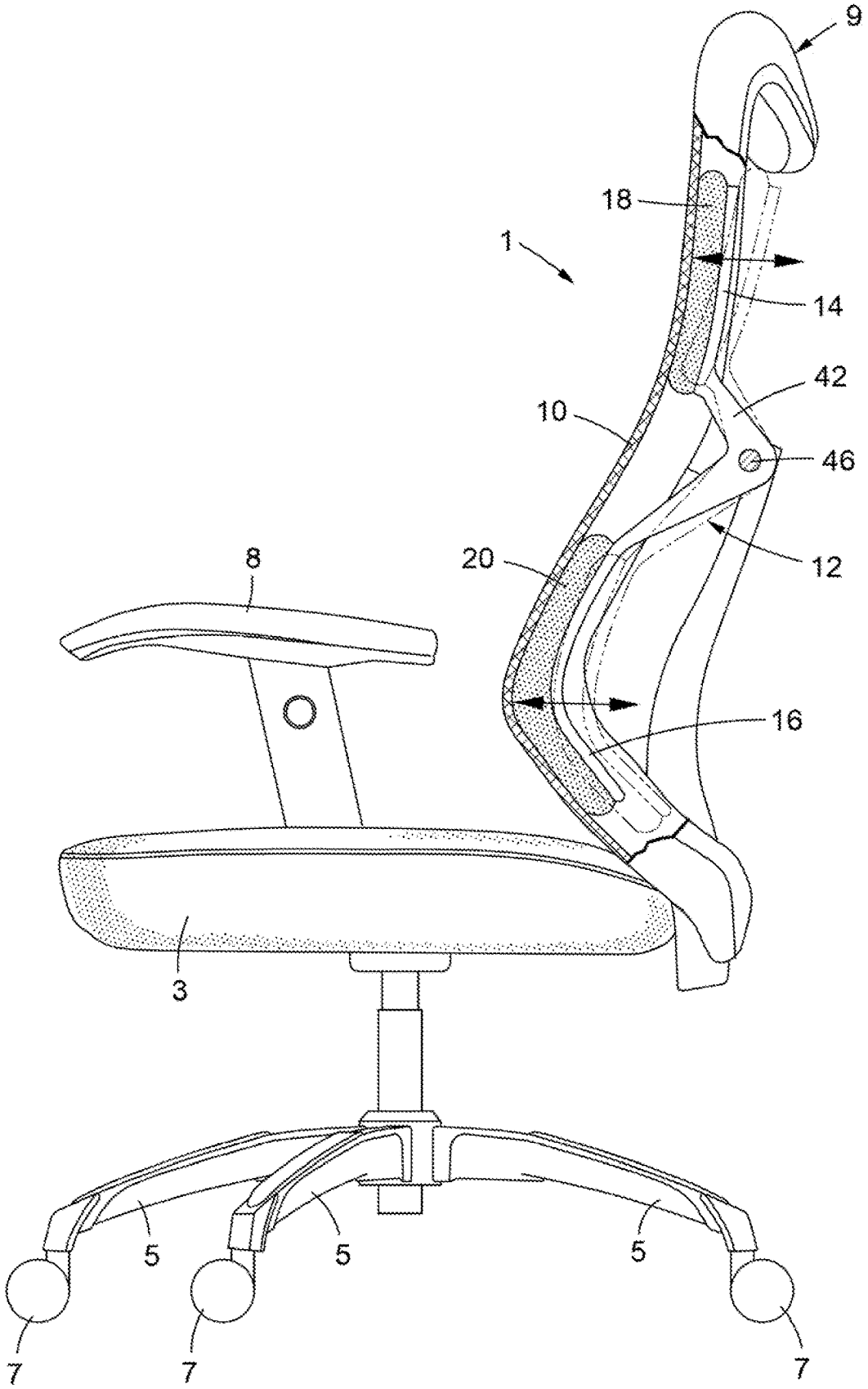
FIG. 4 is a partial cross-section showing the mesh back rest and the one-piece full lumbar back support connected to the back of the chair of FIG. 1 and pressing against the mesh back rest.

In accordance with a first embodiment of this invention, and referring to FIG. 2 of the drawings, a full lumbar back support 12 is shown connected to back 9 of the chair 1 and including an upper lumbar support 14 and a lower lumbar support 16 that are integrally connected together to lie one above the other as a single piece. The full lumbar back support 12 shown in FIG. 2 is ideally manufactured from a flexible material having a spring memory such as, for example, a mixture of polypropylene and nylon. Each of the upper and lower lumbar supports 14 and 16 has a pad 18 and 20 attached to the front thereof. The pads 18 and 20 are manufactured from a cushion material to lie on and press against the outside surface of the mesh back rest of the chair 1. As is best shown in FIG. 4, the cushion pad 18 of the upper lumbar support 14 is positioned to engage the upper lumbar area of the back of a user seated in the chair and leaning back against the inside surface of the mesh back rest 10. The cushion pad 20 of the lower lumbar support 16 is positioned below the upper lumbar support 14 to engage the lower lumbar area of the back of the seated user.

The upper and lower lumbar supports 14 and 16 of the full lumbar back support 12 are contoured to fit against the back of the user. That is, the upper lumbar back support 14 and the cushion pad 18 attached thereto are generally flat to press against the upper lumbar area of the user's back, while the lower lumbar back support 14 and the cushion pad 20 thereof are curved to press against the small of the user's back.

The mesh back rest 10 is surrounded by a frame 24, such that the frame 24 and the mesh back rest 10 surrounded thereby stand upwardly with the chair back 9 from the rear of the seat 3. The full lumbar back support 12 is held in place against the outside of the mesh back rest 10 by left side and right side horizontally (i.e., laterally) extending back support arms 26 and 28 and left and right side vertically (i.e., longitudinally) extending back support legs 30 and 32.

One end of the left side horizontally extending back support arm 26 is connected to the top of the left side vertically extending back support leg 30 behind the left side of the mesh back rest 10. The left side vertically extending back support leg 30 extends downwardly from its connection to the horizontally extending left side back support arm 26. The opposite end of the left side horizontally extending back support arm 26 is connected by a fastener 34 to the left side of the frame 24 at the back 9 of the chair 1, and the bottom of the left side vertically extending back support leg 30 is connected by a fastener 36 to the frame 24 below the fastener 34.

Likewise, one end of the right side horizontally extending back support arm 28 is connected to the top of the right side vertically extending back support leg 32 behind the right side of the mesh back rest 10. The right side vertically extending back support leg 32 extends downwardly from its connection to the right side horizontally extending back support arm 28. The opposite end of the right side horizontally extending back support arm 28 is connected by a fastener 38 to the right side of the frame 24 at the back 9 of the chair 1, and the bottom of the right side vertically extending back support leg 32 is connected by a fastener 40 to the frame 24 below the fastener 38.

Figure 3:
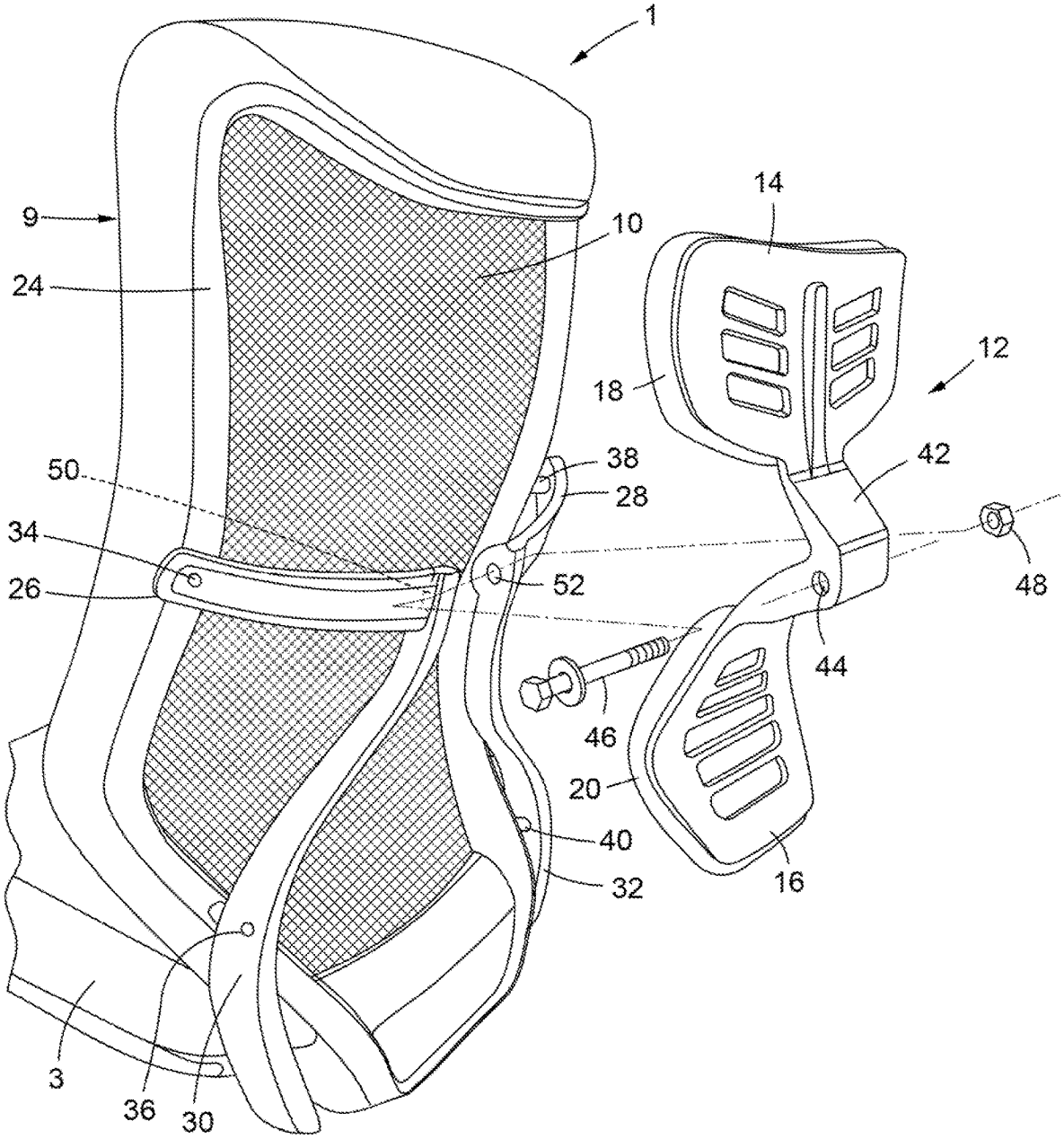
FIG. 3 is an exploded view showing the back of the chair of FIG. 1 and the one-piece full lumbar back support to be connected thereto so as to press against the mesh back rest.

Details of the one-piece full lumbar back support 12 are described while referring to FIG. 3 of the drawings. The upper and lower lumbar supports 14 and 16 are shown connected one above the other by means of an integral joint having a curved neck 42 that runs continuously and coextensively therebetween. A hole 44 extends laterally through the neck 42 to receive an elongated fastener (e.g., a threaded pass-through bolt) 46 by which to hold the full lumbar back support 12 in place against the outside of the mesh back 10. A complementary fastener (e.g., a threaded nut) 48 is connected to the elongated fastener 46 to prevent the removal of fastener 46 from the hole 44 through the neck 42.

A first fastener receiving hole 50 is formed through the top of the left side vertically extending back support leg 30, and a second fastener receiving hole 52 is formed through the top of the right side vertically extending back support leg 32. The first and second fastener receiving holes 50 and 52 are axially aligned with one another for the receipt of the pass-through bolt 46.

The opposing tops of the left and right side vertically extending back support legs 30 and 32 are separated from one another to create a space therebetween within which to position the neck 42 of the one-piece full lumbar back support 12 such that the first and second bolt receiving holes 50 and 52 are axially aligned with one another and with the bolt receiving hole 44 through neck 42. With the pass-through bolt 46 pushed through the axially aligned bolt receiving holes 44, 50 and 52 and the nut 48 tightened against the bolt, the full lumbar back support 12 is firmly secured to the back 9 of the chair 1.

In this regard, FIG. 4 shows the one-piece full lumbar back support 12 fixedly attached to the back 9 of the chair 1 by the bolt 46 with the upper and lower lumbar supports 14 and 16 and the cushion pads 18 and 20 thereof lying on the outside surface of and applying pressure against the mesh back rest 10. By virtue of the flexible characteristic of the lumbar back support 12, the upper and lower lumbar supports 14 and 16 are adapted to bend (i.e., flex) back and forth as represented by the phantom lines in FIG. 4 and by the directional arrows when the back of a seated individual is first moved against the mesh back rest 10 and is then moved away from the mesh back rest.

When they bend back in a first direction in response to the user's back being moved against the mesh back rest 10, the upper and lower lumbar supports 14 and 16 are stressed and store energy. Because the flexible full lumbar bar support 12 has a spring memory, when the user's back moves forward in an opposite direction away from back rest 10, the upper and lower lumbar back supports 14 and 16 will release their stored energy and automatically bend forwards. Regardless of whether the user's back is at rest or pushing back against the mesh back rest 10, the full lumbar back support 12 applies continuous pressure through the mesh back rest to provide support for the upper and lower lumbar areas of the back of the user seated in the chair and leaning back.

Figure 5:
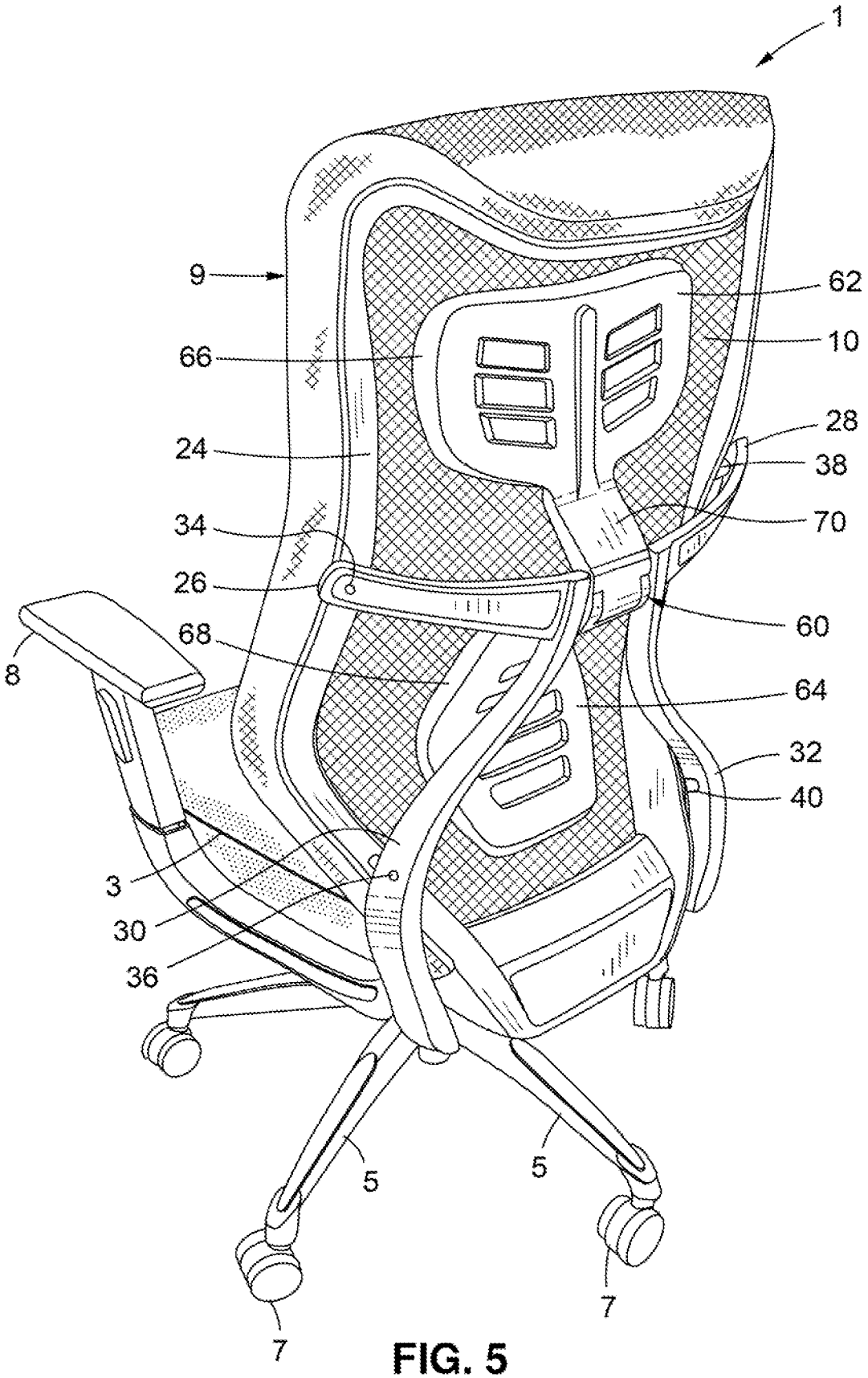
FIG. 5 shows the chair of FIG. 1 having a two-piece full lumbar back support connected to the back of the chair and including upper and lower lumbar supports pressing against the mesh back rest of the chair.
Figure 6:
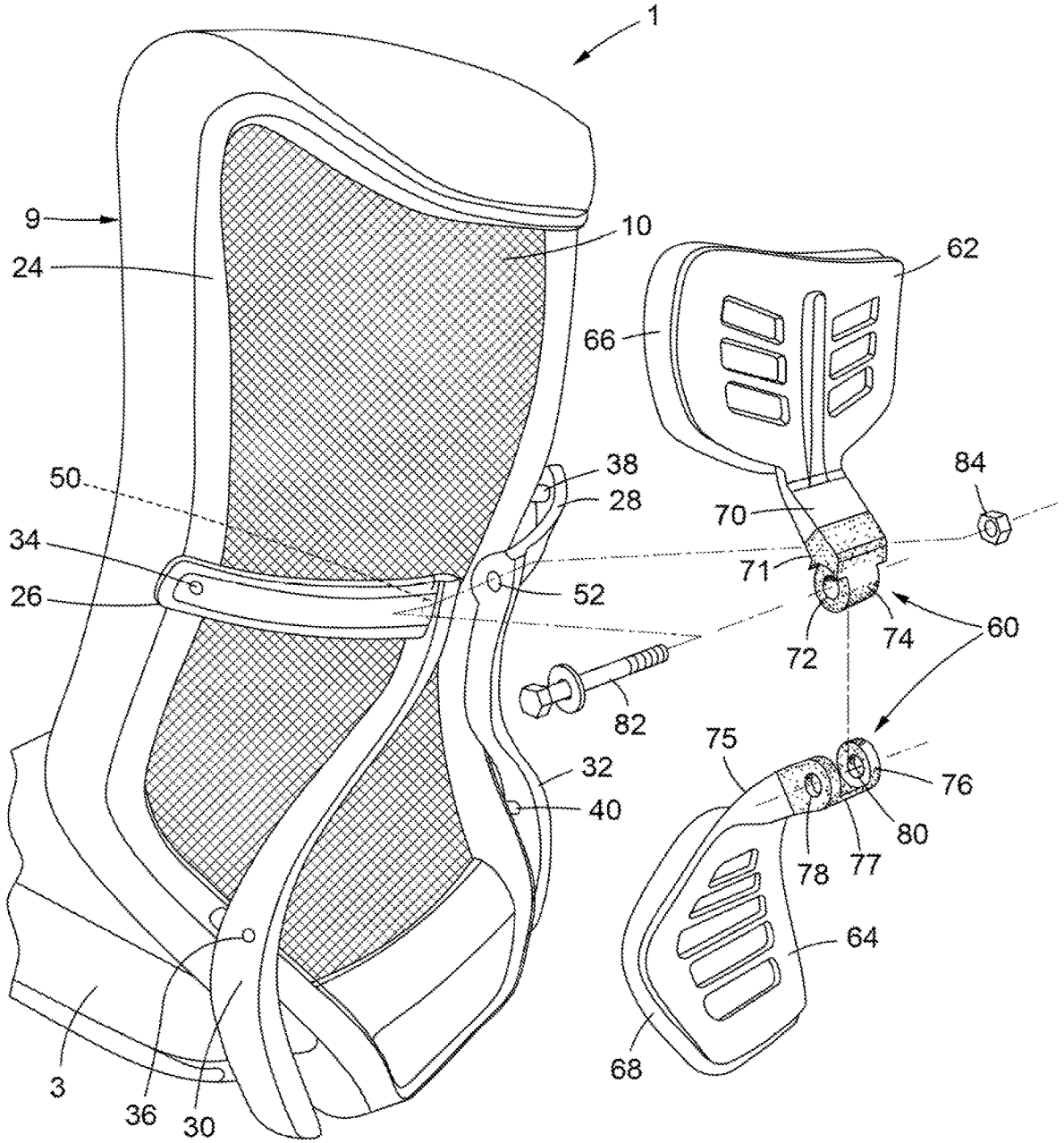
FIG. 6 is an exploded view showing the back of the chair of FIG. 5 and the two-piece full lumbar back support to be connected thereto to press against the mesh back rest.
Figure 7:
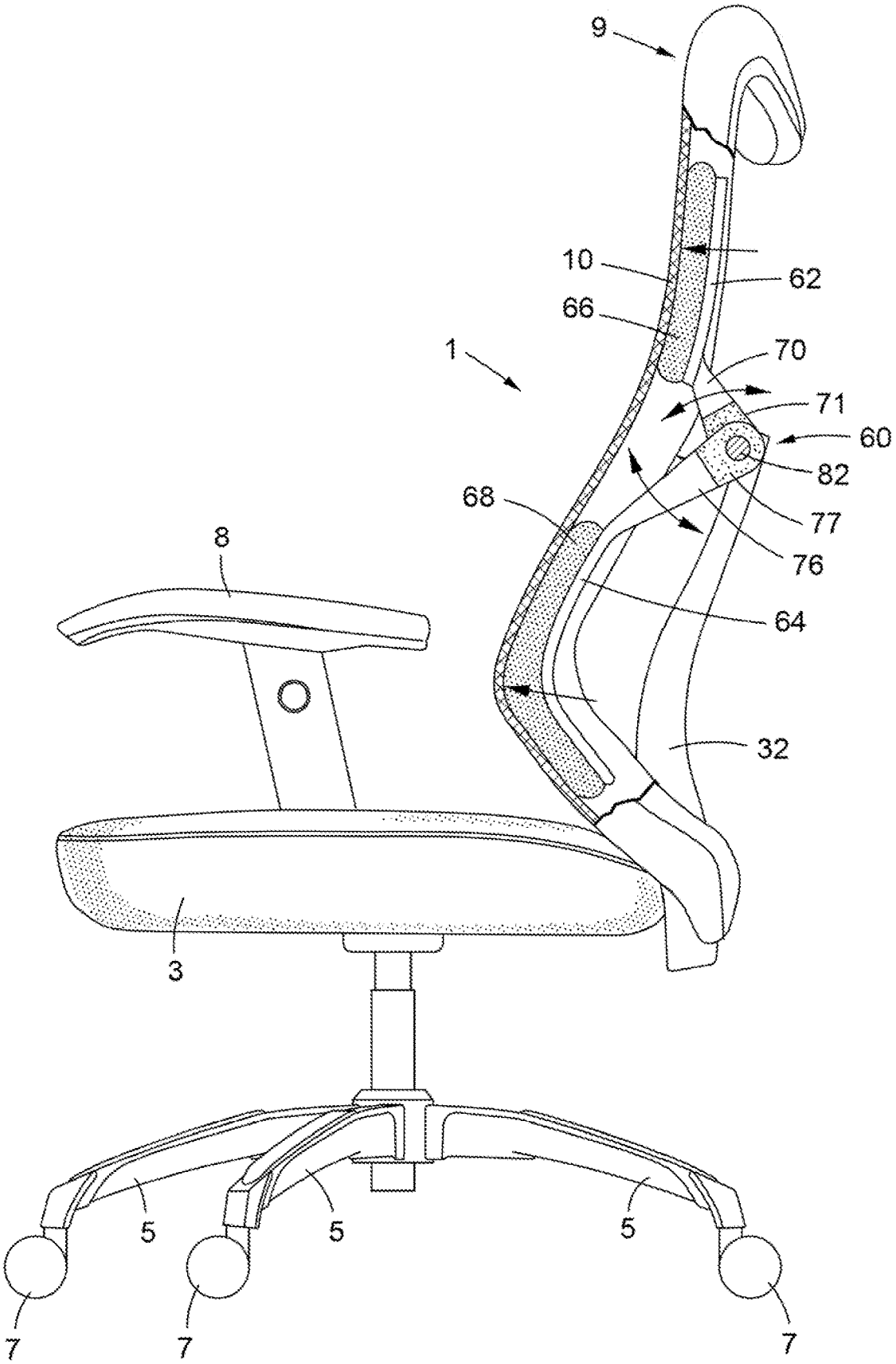
FIG. 7 is a partial cross-section showing the mesh back rest and the two-piece full lumbar back support connected to the back of the chair of FIG. 5 and pressing against the mesh back rest.

In accordance with a second embodiment of this invention, and turning now to FIGS. 5, 6 and 7 of the drawings, the one-piece full lumbar back support 12 shown in FIG. 3 is replaced by a two-piece full lumbar back support 60. The full lumbar back support 60 of FIGS. 5-7 is shown attached to the back of a chair that may be identical to the chair 1 shown in FIG. 2. Therefore, the same reference numerals that were used to describe the chair 1 will also be used to describe the chair shown in FIGS. 5-7. In this same regard, the two-piece full lumbar back support 60 is attached to the back 9 of the chair 1 of FIGS. 5-7 so as to lie on the outside surface of the mesh back rest 10 and apply a continuous pressure through the mesh to provide support for both the upper and lower lumbar areas of the user's back.

As in the case of the previously disclosed full lumbar back support 12, the full lumbar back support 60 includes an upper lumbar support 62 and a lower lumbar support 64. Cushion pads 66 and 68 are attached to the front of the upper and lower lumbar supports 62 and 64 so as to lie on and press against the mesh back rest 10. A coupling neck 70 depends downwardly from the bottom of the upper lumbar support 62. As is best shown in FIG. 6, a cylindrical coupling channel 72 runs through a cylindrical coupler 74 that is carried at the bottom of the coupling neck 70. A pair of coupling ears 75 and 76 stand upwardly from the top of the lower lumbar support 64. The pair of coupling ears 75 and 76 are spaced from one another. A hole 78 and 80 is formed through each of the upstanding coupling ears 75 and 76, such that the holes are axially aligned with one another.

A portion 71 of the coupling neck 70 which carries the cylindrical coupler 74 at the bottom of the upper lumbar support 62 and a portion 77 of each of the coupling ears 75 and 76 at the top of the lower lumbar support 64 are manufactured from a resilient elastic material having a spring memory. The cylindrical coupler 74 at the bottom of the coupling neck 70 is sized to fit in the space between the pair of upstanding coupling ears 74 and 76 such that the cylindrical channel 72 that runs through the coupler 74 is axially aligned with the holes 78 and 80 that are formed through coupling ears 75 and 76.

The cylindrical coupler 74 is first located between the pair of coupling ears 75 and 76. The aforementioned cylindrical coupler 74 and the coupling ears 75 and 76 are then located in the space between the opposing tops of the left and right side vertically extending back support legs 30 and 32 that are connected to the back 9 of the chair 1 as previously described such that the first and second bolt receiving holes 50 and 52 are axially aligned with each other and with the coupling channel 72 through the coupler 74 and the holes 78 and 80 through the coupling ears 75 and 76. An elongated threaded fastener (e.g., a pass-through bolt) 82 is pushed through the axially aligned bolt receiving holes 50 and 52, the ear holes 78 and 80, and the coupling channel 72. A complementary threaded fastener (e.g., a nut) 84 is then tightened against the bolt 82, whereby the full lumbar back support 60 is fixedly secured to the back of the chair 1. In this case, the upper and lower lumbar supports 62 and 64 are adapted to bend when the user's back pushes back against the mesh back rest 10.

FIG. 7 shows the two-piece full lumbar back support 60 fixedly held in place by the pass-through bolt 82 at the back 9 of chair 1 with the upper and lower lumbar supports 62 and 64 and the cushion pads 66 and 68 thereof lying on the outside surface of and applying pressure to the mesh back 10. As represented by the directional arrows of FIG. 7, when the user leans back in the chair 1 against the mesh back 10, the upper and lower back supports 62 and 64 will correspondingly bend (i.e., flex) backwards relative to the pass-through bolt 82 and move in a first direction. Because of the spring memory of the resilient portions 71 and 77 of the coupling neck 70 and the coupling ears 76 and 77, when the user leans forwards, the upper and lower back supports 62 and 64 will automatically recover so as to bend forwards and move in an opposite direction. As in the case of the full lumbar back support 12, regardless of whether the user's back is at rest or being pushed against the mesh back rest 10, the full lumbar back support 60 of FIGS. 5-7 applies continuous pressure through the mesh to provide support for the upper and lower lumbar areas of the back of the user seated in the chair and leaning back.

As an option, rather than the upper and lower back supports 62 and 64 of the two-piece full lumbar back support 60 having resilient portions 71 and 77, the upper and lower back supports 62 and 64 may be manufactured entirely from a resilient elastic material so as to be capable of bending with one another in first and opposite directions at the pass-through bolt 82 as the user's back moves back and forth.

Figure 8:
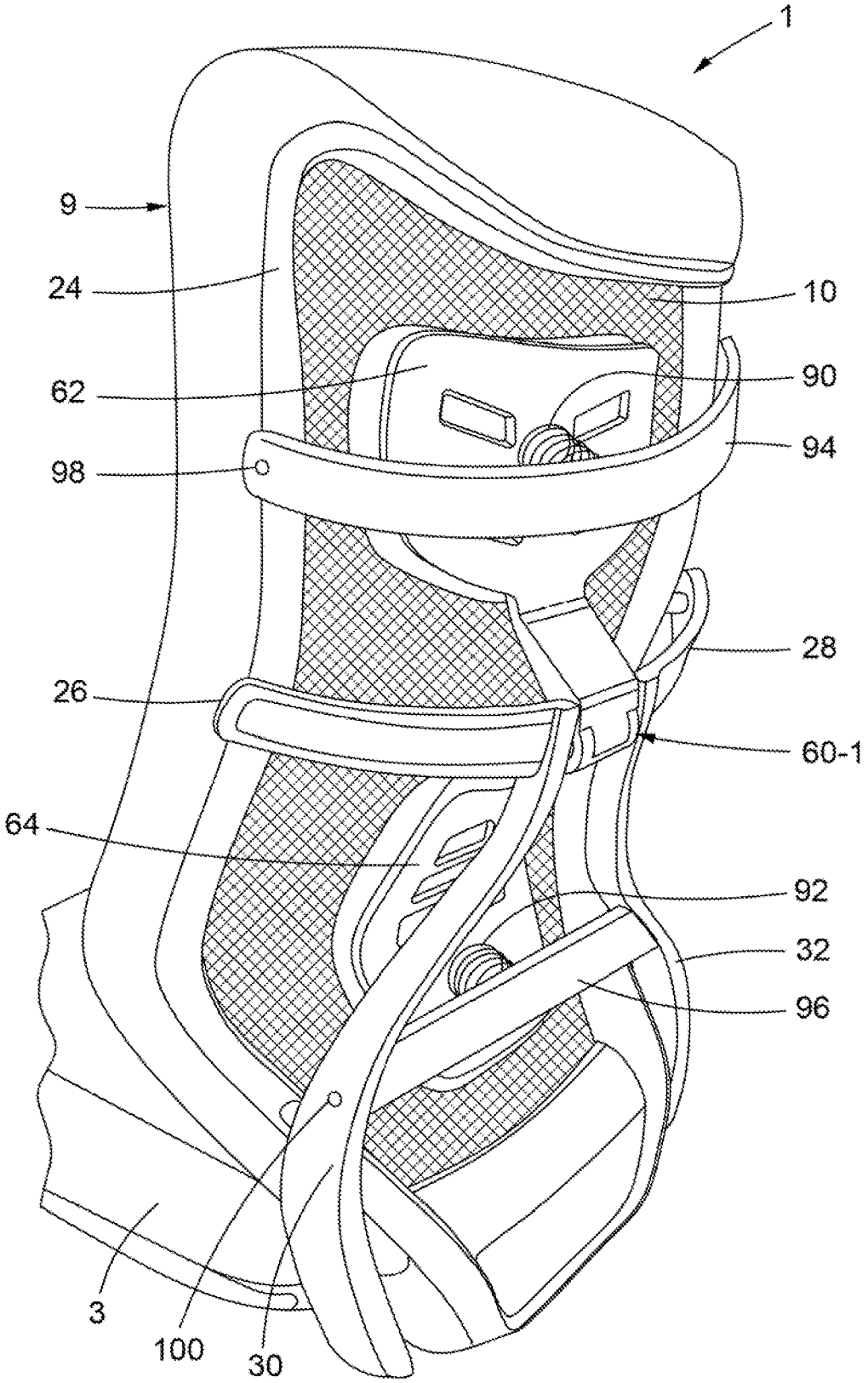
FIG. 8 shows a modification of the two-piece full lumbar back support of FIGS. 5-7 connected to the back of the chair of FIG. 5 at which upper and lower springs urge the upper and lower lumbar supports of the two-piece full lumbar back support to press against the mesh back rest.

FIG. 8 of the drawings shows a modification 60-1 of the two-piece full lumbar back support 60 shown in FIGS. 5-7. In this case, the previously described resilient neck portion 71 and ear portions 77 shown in FIG. 7 which urge the upper and lower lumbar supports 62 and 64 to bend in opposite directions when the user leans backwards and forwards in the chair are eliminated. Instead, upper and lower (e.g., coil) springs 90 and 92 are connected at first ends thereof to the backs of respective ones of the upper and lower lumbar supports 62 and 64 of the modified full lumbar back support 60-1. The opposite ends of the springs 90 and 92 engage respective upper and lower spring retaining braces 94 and 96 that extend one above the other and laterally across the back 9 of the chair 1 behind the lumbar supports 62 and 64. The opposite ends of each of the laterally extending upper and lower spring retaining braces 94 and 96 are connected by fasteners 98 and 100 to the left and right sides of the frame 24 that surrounds the mesh back rest 10.

The modified full lumbar back support 60-1 shown in FIG. 8 is pivotally connected by means of a pass-through bolt, such as that designated 82 in FIG. 6, so as to lie in the space between the opposing tops of the left and right side vertically extending back support legs 30 and 32 at the back 9 of the chair 1. Therefore, when the user leans back in the chair 1, the upper and lower lumbar supports 62 and 64 will rotate in a first direction around the bolt 82 and move backwards. Each of the springs 90 and 92 is correspondingly compressed between lumbar supports 62 and 64 and the opposing spring retaining braces 94 and 96, whereby the springs store energy. When the user leans forward in the chair, the upper and lower springs 90 and 92 will be allowed to expand and release their stored energy. Accordingly, the upper and lower lumbar supports 62 and 64 of the full lumbar back support 60-1 will now be urged by the expanding springs 90 and 92 so as to rotate in an opposite direction around the bolt 82 and move forwards against the mesh back rest 10. As with the full lumbar back supports 14 and 60 previously described herein, regardless of whether the user's back lies at rest or pushes back against the mesh back rest 10, the full lumbar back support 60-1 of FIG. 8 will apply a continuous pressure through the mesh to provide support to the upper and lower lumbar areas of the back of the user seated in the chair and leaning back.

The invention claimed is:

1. A chair, comprising:

a seat to support the weight of a user sitting in the chair;

a set of legs connected to the seat;

a chair back standing upwardly at the rear of the seat, said chair back having a flexible back rest to receive the back of the user leaning back in the chair;

a flexible lumbar back support having a spring memory and being connected to the chair back so as to lay on and press against the flexible back rest of said chair back to apply a corresponding pressure against the back of the user and thereby provide support for the user's back, said flexible lumbar back support including upper and lower lumbar supports connected together and located one above the other so as to be positioned to lie on upper and lower lumbar areas of the user's back, said upper and lower lumbar supports bending backwards and moving in a first direction in response to the user's back being moved against said flexible back rest, and the spring memory of said flexible lumbar back support causing said upper and lower lumbar supports to bend forwards in an opposite direction in response to the user's back being moved away from said flexible mesh back rest; and a fastener extending laterally through the flexible lumbar back support between said upper and lower lumbar supports thereof by which said flexible lumbar back support is fixedly connected to the chair back and the upper and lower lumbar supports of said flexible lumbar back support are adapted to bend backwards and forwards in said first and opposite directions.

2. The chair recited in claim 1, wherein the flexible back rest of the chair back that receives the back of the user is manufactured from mesh.

3. The chair recited in claim 2, wherein the flexible mesh back rest of the chair back has an inside surface against which to receive the back of the user and an outside surface lying opposite said inside surface, said flexible lumbar back support lying against the outside surface of said flexible mesh back rest by which to apply said pressure against the back of the user through said flexible mesh back rest.

4. The chair recited in claim 1, wherein each of the upper and lower lumbar supports of said flexible lumbar back support has a cushion pad attached thereto and configured to apply a cushioned pressure against the upper and lower lumbar areas of the back of the user.

5. The chair recited in claim 1, wherein at least one of the upper and lower lumbar supports of said flexible lumbar back support is curved to have a shape that conforms to the shape of a corresponding one of the upper and lower lumbar areas of the back of the user.

6. The chair recited in claim 1, wherein the upper and lower lumbar supports of said flexible lumbar back support are integrally connected together to lie one above the other by way of a joint extending continuously and coextensively therebetween, said fastener comprising a bolt that extends laterally through said joint to fixedly connect said flexible lumbar back support to the chair back.

7. The chair recited in claim 1, wherein one of the upper and lower lumbar supports of said flexible lumbar back support includes a coupler depending therefrom and having a hole formed therein, and the other one of said upper and lower lumbar supports having a pair of coupling ears depending therefrom, said pair of coupling ears being spaced from one another and having a hole formed in each of said pair, said coupler being positioned between said pair of coupling ears, and said fastener comprising a bolt extending through the holes formed in each of said coupler and said pair of coupling ears by which to fixedly connect said flexible lumbar back support to the chair back.

8. A chair, comprising:

a seat to support the weight of a user sitting in the chair, a set of legs connected to the seat;

a chair back standing upwardly at the rear of the seat, said chair back having a flexible mesh back rest to receive the back of the user leaning back in the chair;

a full lumbar back support including upper and lower lumbar supports located one above the other and pivotally connected to said chair back so as to lay on and press against the flexible mesh back rest thereof and adapted to apply corresponding pressures to upper and lower lumbar areas of the back of the user sitting in the chair, said upper and lower lumbar supports rotating backwards and moving in a first direction in response to the user's back being moved against said flexible mesh back rest, and said upper and lower lumbar supports rotating forwards and moving in an opposite direction in response to the user's back being moved away from said flexible mesh back rest; and upper and lower springs located at said chair back and engaging respective ones of the upper and lower lumbar supports of said full lumbar back support, said upper and lower springs being compressed to store energy when the user's back is moved against said flexible mesh back rest and said upper and lower back supports rotate backwards in said first direction, and said upper and lower springs expanding and releasing their stored energy to urge said upper and lower lumbar supports to rotate forwards in said opposite direction when the user's back is moved away from said flexible mesh back rest.

9. The chair recited in claim 8, further comprising a fastener extending through said full lumbar back support between said upper and lower lumbar supports thereof, said fastener being connected to said chair back to establish a pivot axis around which the upper and lower lumbar supports of said full lumbar back support rotate backwards and forwards in said first and opposite directions.

10. A chair, comprising:

a seat to support the weight of a user sitting in the chair;

a set of legs connected to the seat;

a chair back standing upwardly at the rear of the seat, said chair back having a frame and a mesh back rest surrounded by said frame to receive the back of the seated user leaning back in the chair, said frame having a top, a bottom and left and right sides;

a full lumbar back support including upper and lower lumbar supports connected one above the other by a joint located therebetween so as to lay on and press against the flexible mesh back rest and thereby apply corresponding pressures to upper and lower lumbar areas of the back of the user sitting in the chair, said joint having a coupling hole formed therein;

left and right side back support arms extending horizontally and in opposite directions from the joint of said full lumbar back support for connection to respective ones of the left and right sides of the frame that surrounds the mesh back, said left and right side back support arms being spaced from one another to receive said joint therebetween;

left and right side back support legs extending vertically downward from the joint of said full lumbar back support for connection to the bottom of the frame that surrounds the mesh back, each of said left and right side back support legs having a fastener receiving hole formed therein, such that the coupling hole formed in the joint of said full lumbar back support is axially aligned with each of the fastener receiving holes formed in said left and right side back support legs; and an elongated fastener extending through the axially aligned first and second fastener receiving holes formed in said left and right side back support legs and the coupling hole formed in the joint of said full lumbar back support by which to connect said full lumbar back support to the frame at the back of the chair so that the upper and lower lumbar supports of said full lumbar back support are adapted to move back and forth with respect to said elongated fastener in response to the back of the seated user moving back and forth towards and away from the mesh back rest.

11. The chair recited in claim 10, wherein said full lumbar back support is flexible so as to have a spring memory such that the upper and lower lumbar supports of said full lumbar back support are adapted to bend at said joint located therebetween and move back and forth towards and away from the mesh back rest.

12. The chair recited in claim 10, wherein the upper and lower lumbar supports of said full lumbar back support are pivotally connected to one another at said joint located therebetween, such that said upper and lower lumbar supports are rotatable around said elongated fastener and so as to move back and forth independently of one another towards and away from the mesh back rest.

* * * * *